United States Patent [19]

Raba et al.

[11] Patent Number: 4,613,136

[45] Date of Patent: Sep. 23, 1986

[54] POOL SIDE HOOP GAME BACKBOARD

[76] Inventors: John B. Raba, 2901 NE. 1 Ave., Pompano Beach, Fla. 33064; Art Graham, 2824 S. Edgehill La., Cooper City, Fla. 33026

[21] Appl. No.: 767,626

[22] Filed: Aug. 20, 1985

[51] Int. Cl.[4] ..... A63B 63/08

[52] U.S. Cl. ..... 273/1.5 R; 248/DIG. 10; 273/411

[58] Field of Search ..... 273/1.5 R, 402, 411; 248/DIG. 10

[56] References Cited

U.S. PATENT DOCUMENTS

| | | | |
|---|---|---|---|
| 2,818,254 | 12/1957 | Dunn | 273/1.5 R |
| 2,889,149 | 6/1959 | Williams | 273/1.5 R X |
| 3,017,183 | 1/1962 | Chalcroft | 273/1.5 R |
| 3,388,109 | 6/1968 | Woods | 273/1.5 R |
| 3,743,286 | 7/1973 | Weinhagen | 273/1.5 R |
| 3,841,631 | 10/1974 | Dolan | 273/1.5 R |
| 3,901,506 | 8/1975 | Caveney | 273/1.5 A |
| 4,109,910 | 8/1978 | Gleason | 248/DIG. 10 X |
| 4,145,044 | 3/1979 | Wilson et al. | 273/1.5 R |
| 4,239,214 | 12/1980 | Brenner | 273/1.5 R |
| 4,307,887 | 12/1981 | Weiss | 273/411 |
| 4,346,895 | 8/1982 | Browniee | 248/DIG. 10 X |

FOREIGN PATENT DOCUMENTS

| | | | |
|---|---|---|---|
| 665898 | 10/1965 | Belgium | 273/1.5 R |

*Primary Examiner*—Paul E. Shapiro

*Attorney, Agent, or Firm*—Eugene F. Malin

[57] ABSTRACT

A free standing, self-contained, poolside, hoop game device is disclosed. The device includes three basic components including a ballast fillable base, a height adjustable backboard surface and a hoop. The device is comprised of a lightweight, corrosion resistant material and is easily constructed, disassembled and drained of ballast for storage or transportation. The backboard preferably includes three wings with planar surfaces angled to aid in keeping the ball in play.

4 Claims, 4 Drawing Figures

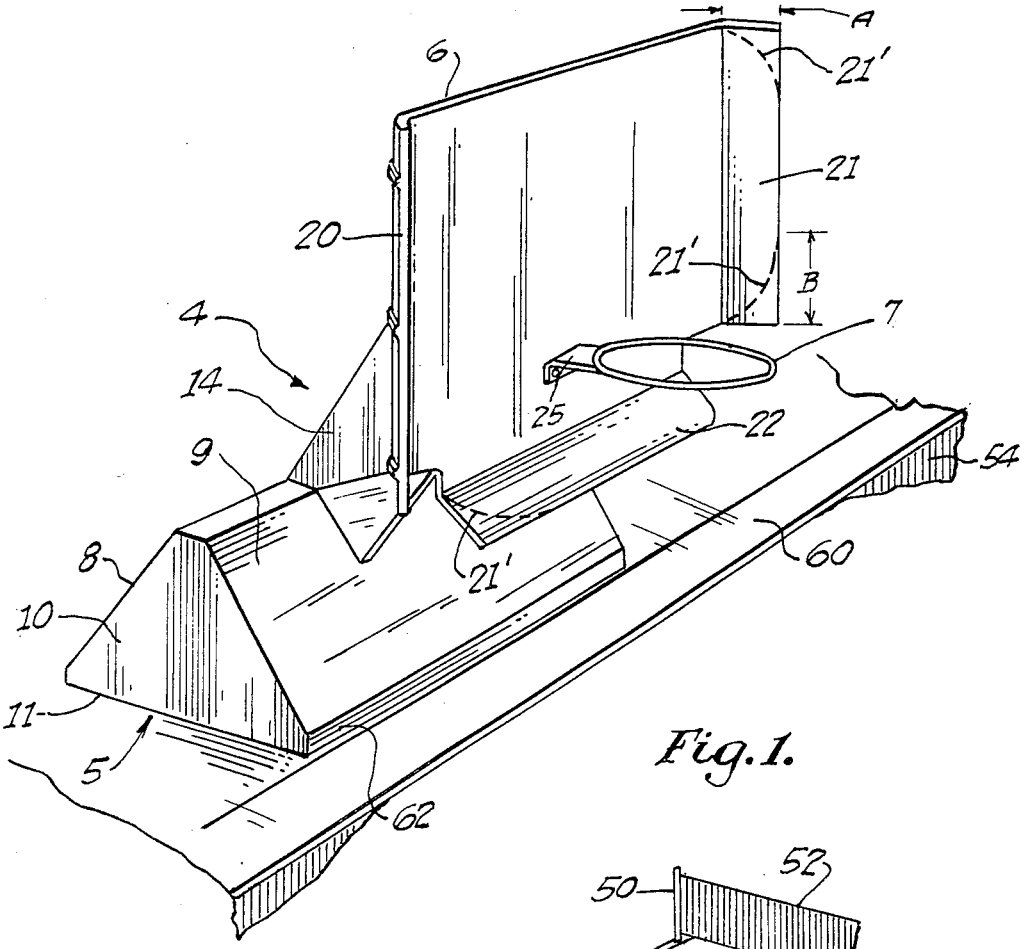
Fig.1.
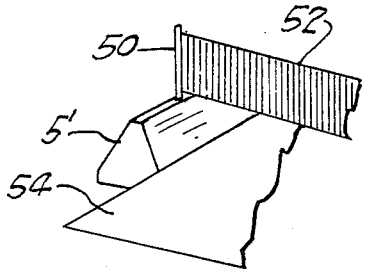
Fig.4
Fig.2.
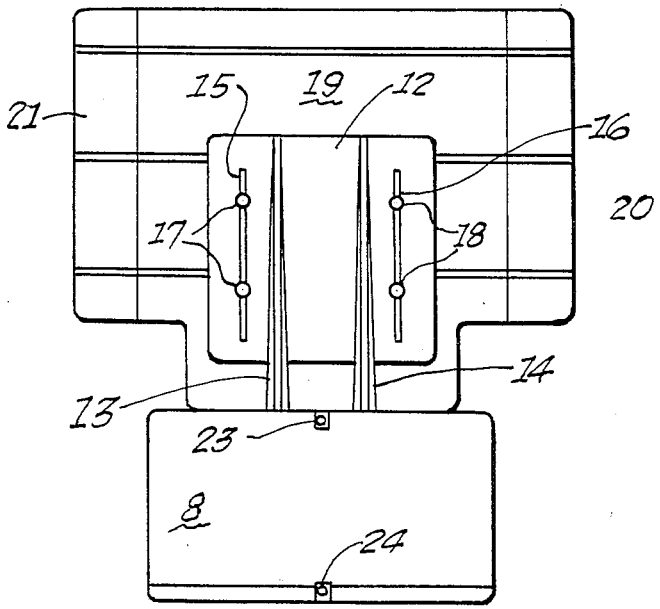
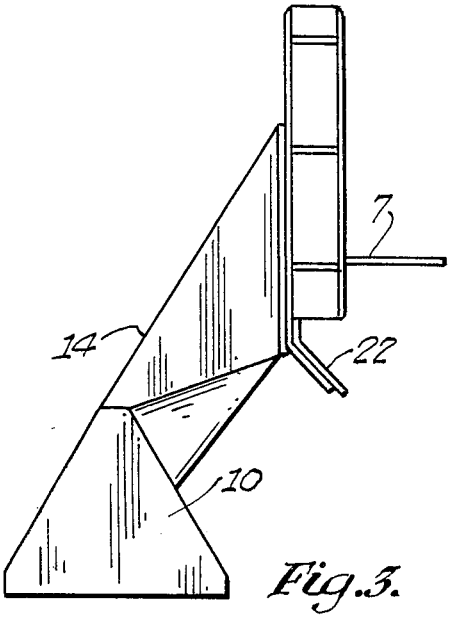
Fig.3.

POOL SIDE HOOP GAME BACKBOARD

FIELD OF THE INVENTION

The present invention relates generally to the field of backboards used in connection with ball-through-the-hoop type games. More specifically, the invention relates to a poolside backboard of novel design and construction which provides rebound wings and a free standing capability.

BACKGROUND OF THE INVENTION

Basketball is the most widely known and played of the ball-through-the-hoop type games. Due to the popularity of the basic concept of the sport a number of variations have been developed. For example, U.S. Pat. No. 4,300,764 to Burke discloses the use of a shield or skirt in connection with the hoop in order to discourage "dunking" and encourage the players to release the ball at a point spaced peripherally of the rim.

U.S. Pat. No. 3,901,506 to Caveney discloses a portable, foldable, backboard type device. The invention includes side frame deflectors pivotally arranged on a main back frame adapted for mounting on a conventional backboard. The device is primarily useful in returning the ball to the player. Although the device is conveniently foldable and portable it must be used in conjunction with a conventional backboard, i.e. it is not self-contained.

U.S. Pat. No. Des. 260,154 to Dremel discloses an ornamental design which includes slide walls or flaps to be used on a tennis table. The flaps can aid in keeping the ball in play.

U.S. Pat. No. 4,239,214 to Brenner discloses a ball-in-the-hoop type game which uses six different types of backboards. Each of the backboards is arranged differently with respect to the basket hoop for presenting a different variety of bank shots to be made from a station positioned in front of each backboard.

One striking feature lacking in the above referred to devices is self-containment, i.e. they must be used in combination with a conventional device, e.g. tennis table, backboard and/or basketball court. Accordingly, such devices are not useful to a large percentage of the population.

SUMMARY OF THE INVENTION

The present invention is a completely self-contained free standing backboard device useful for playing a poolside ball-in-the-hoop game. The invention is generally comprised of three basic parts: (1) the base which includes a large tank for holding water or other suitable ballast and an attachment plate; (2) a backboard which is a planar surface adjustably connectable to the attachment plate of the base—the backboard preferably including a plurality of wings extending therefrom; and (3) a hoop connected to the planar surface of the backboard.

A primary object of the invention is to provide a free standing backboard device useful in playing a poolside ball-in-the-hoop type game.

Another object of the invention is to provide such a backboard device which can be filled with water or other suitable ballast material thus eliminating the need for anchoring attachments between the backboard base and the surface on which the device rests, e.g. the pool deck.

Yet another object of the invention is to provide such a backboard device wherein the height of the backboard and hoop is adjustable.

Another object is to provide such a device wherein the ballast can be easily drained from the base; and where the base, backboard planar surface and hoop can be easily detached from each other for easy storage or transportation.

Another object is to provide such a device which includes wings extending from the backboard planar surface for aiding in keeping the ball in play.

These and other objects of the invention will become apparent to those skilled in the art upon reading this disclosure.

BRIEF DESCRIPTION OF THE DRAWINGS

FIG. 1 is a frontal prospective view of a preferred embodiment of the present invention;

FIG. 2 is a back view of the invention shown in FIG. 1; and

FIG. 3 is a side view of the invention shown in FIGS. 1 and 2.

FIG. 4 is an illustration of use of one base with a net to another base not shown.

DETAILED DESCRIPTION OF THE PREFERRED EMBODIMENT

The poolside backboard device 4 of the present invention is shown in FIG. 1 in its preferred form. The device 4 is comprised of three essential components referred to generally as the base 5, backboard 6 and hoop 7. Each of the components 5, 6 and 7 includes subcomponents described hereinafter.

The base 5 is preferrably in the form of an elongate hollow truncated pyramidal-shaped support triangular in cross-section as shown in FIG. 1, but may have any shape provided its bottom is flat and/or is capable of providing a stable planar support means for the device 4. The base 5 includes sidewalls 8 and 9, end walls 10 and 10' (not shown) and a bottom surface 11. The base 5 is preferrably in the form of a container with a lower area substantially greater in volume than the upper area toaid in stability. The elongated triangular shaped base 5 is most preferred.

Referring now to FIG. 2 additional components of the base 5 can be described. An attachment plate 12 is connected to the base 5 via support members 13 and 14. A single support means (not shown) may be used of the same shape positioned between the supports 13 and 14 as shown. The plate 12 has adjustment opening vertical slits 15 and 16 through which bolts 17 and 18 fit and connect to the planar backboard surface 19. When each pair of the bolts 17 and 18 are loosened, the height of the backboard component 6 can be adjusted vertically e.g. lowered for small children.

The invention 4 is used in playing a game wherein a swimming pool is the playing field. When playing a game from a pool it becomes inconvenient and tiresome to leave the pool repeatedly to retrieve the ball. Accordingly, wings 20, 21 and 22 are used as an aid for keeping the ball in play. The wings 20 and 21 aid in preventing the ball from going off to one side or the other. The wing 22 as seen in FIG. 3 aids in returning the ball to play after a successful hoop shot is made. The wings 20, 21 and 22 may be of different sizes proportioned to the backboard planar surface 19 than that shown in the Figures. The wings may also be positioned at different angles than shown but are preferrably set at an angle of about 45 degrees with respect to the surface 19. This angle has been found useful in returning the ball to play without interfering with play. Although the wings shown in the Figures are fixed to decrease manufacturing costs, the wings could be set on hinges to make their angle with respect to the surface 19 adjustable or allow the wings to be removed or swung behind the surface 19.

The base 5 preferrably includes an opening and more preferrably 2 openings such as the fill opening 23 and drain opening 24 shown in FIG. 2. Once the device 4 is put on the desired poolside location the opening 23 is used to fill the base 5 with water or other suitable ballast. Because of the weight of the ballast no attachments are needed between the device 4 and the pool deck. If movement of the device 4 becomes necessary the water is drained from the opening 24.

To store or transport the device 4 the base 5 is drained and it is disconnected from the backboard 6 which is in turn disconnected from the bracket 25 which connects the hoop 7 to the planar surface 19.

The entire device 4 may be constructed of any suitable rigid material, but is preferrably formed of a lightweight, corrosion resistant, rigid material, such as a polyethelene or polyurethane plastic. Such materials are inexpensive and easy to use for manufacturing, resist the elements, are watertight and light for ease of movement.

The support arms 13 and 14 may have an extended length for placing the back board 6 over the pool 54 water or for accomodating pool lip 60 of various shapes. The tank 10 may have a lip 62 to rest against the coping 60.

The wings 20, 21 and 22 may be modified in shape by having an outer perimeter as shown in dotted lines 21' for each wing. This shape change provides more strength and less material and provide a safer device.

FIG. 4 shows that the bases may be used in pairs on opposite sides of a pool 54. One base 5' is shown. A post 50 connected to the base holds the net 52. A duplicate base holds the other side of the net. This shows that the board 6 is not limited to hoop games.

The invention has been disclosed and described herein in what is considered to be its most preferred embodiments. However, it is recognized that modifications will ocur to others on reading this disclosure and such modifications are intended to be within the scope of this invention.

What I claim is:

1. A poolside hoop game device comprising:

a truncated substantially pyramidal-shaped elongated hollow lightweight support base having top and bottom planar surfaces and converging front and rear planar faces;

a pair of spaced support members secured to said top surface of said base and extending a short distance forwardly of said front face at an angle of inclination substantially the same as the angle of inclination of said rear face;

a vertical plate secured to said supports;

a vertical planar backboard adjusably connected to said plate and superimposed thereon;

said plate and said backboard including means for varying the height of said backboard relative to a side of a pool;

said planar backboard surface including first and second rebound wings connected along opposite edges of the backboard surface and extending vertically along the edges, said planar backboard surface further including a third rebound wing extending along a lower edge of the backboard surface, said wings being adjustably secured to said backboard surface for providing an angle of about 45 degrees with respect to the planar background surfaces; and a circular hoop connected to said planar backboard surface and being positioned at a right angle with respect to said backboard surface;

said third rebound wing extending along a lower edge of the backboard surface at a point immediately below the connection of the hoop to the backboard surface;

said support base being so constructed and of sufficient stability for solely maintaining said device in an upright position during use thereof.

2. A poolside hoop game device as set forth in claim 1, wherein the base includes a first resealable opening for filling the base with ballast and a second resealable opening for draining ballast.

3. A poolside hoop game device as set forth in claim 2, wherein the base further includes a height adjustable attachment plate having a first and a second vertically extending slit therein whereby the planar backboard surface can be attached to the attachment plate at varying heights along the first and second slits.

4. A poolside hoop game device, as set forth in claim 3, wherein the base and planar backboard surface are comprised of a lightweight, corrosion resistant material.

* * * * *